United States Patent [19]

Okazaki

[11] 4,231,213

[45] Nov. 4, 1980

[54] BOX PACKING MACHINE

[75] Inventor: Gosei Okazaki, Komatsu, Japan

[73] Assignee: Shibuya Kogyo Kabushikigaisha, Ishikawa, Japan

[21] Appl. No.: 43,720

[22] Filed: May 30, 1979

[51] Int. Cl.[3] ..... B65B 57/14; B65B 21/20

[52] U.S. Cl. ..... 53/497; 53/539; 53/247

[58] Field of Search ..... 53/497, 539, 543, 247

[56] References Cited

U.S. PATENT DOCUMENTS

| | | | |
|---|---|---|---|
| 2,755,611 | 7/1956 | McGihon | 53/539 X |
| 3,031,810 | 5/1962 | MacLeod | 53/539 X |

*Primary Examiner*—Travis S. McGehee

*Attorney, Agent, or Firm*—Fidelman, Wolffe & Waldron

[57] ABSTRACT

A box packing machine in which containers such as bottles are fed continuously to form a group of a given number with certain rows and columns and the containers in one group are spaced apart one another at a predetermined distance before being loaded into a box such as a carton. A container space regulating unit is reciprocatingly movable between the first position and the second position defined in the box packing machine. The container space regulating unit receives containers of a given number at the first position. The containers carried on the space regulating unit are spaced apart one another at a predetermined distance while they are being transported to the second position, where the containers are transferred into a box in unison.

12 Claims, 11 Drawing Figures

FIG.3
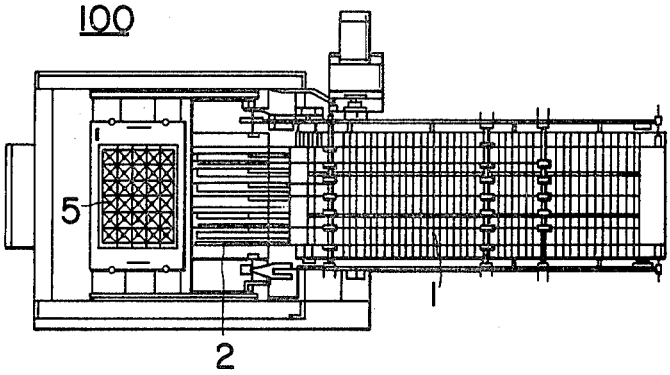
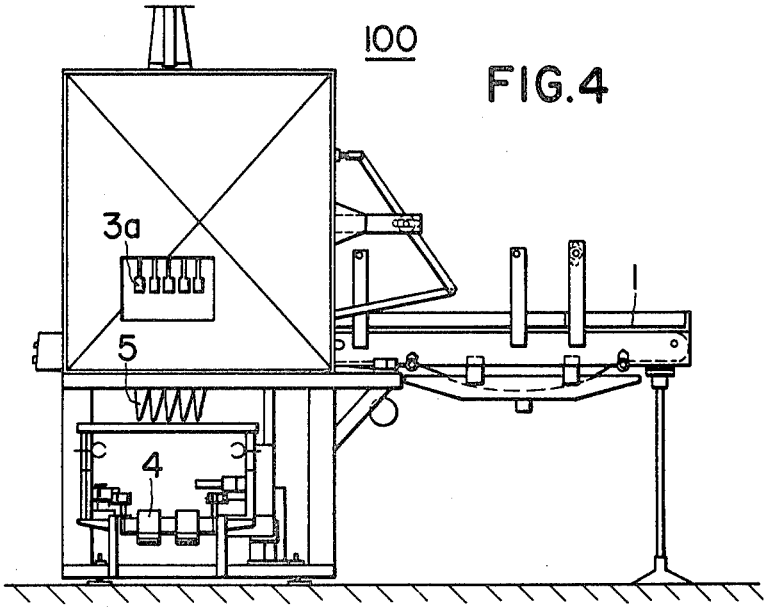
FIG.4

BOX PACKING MACHINE

BACKGROUND OF THE INVENTION

The present invention relates to a box packing machine which can load a group of containers with certain rows and columns into a box without interfering with a separator already placed in the box.

In the case of loading containers such as bottles which have gone through the steps of filling, capping, labling, etc. into a box such as a carton, it has been well known to use a separator to prevent the containers from rubbing each other and from becoming disorderly during shipment. Two kinds of a separator are used; that is, a plate type separator and a lattice type separator which is formed by assembling several plate type separators. Such separators are usually made of a relatively soft material, notably paper.

In general, in the case of packing a box with containers of a given number in unison after placing a separator inside the box, lattice type separators are used. However, since there exists a great possibility that the containers interfere with the separator in such a case, the packing operation can be carried out only with tremendous difficulty. While, in order to increase the packing efficiency, a relatively large number of containers must be handled in unison. But this could only increase the possibility of interference between the containers and the separator. None of the conventional box packing machines satisfy the requirements of speedy handling and non-interference between containers and a separator at the same time. It has been long waited for the advent of a new box packing machine which can satisfy the abovementioned requirements.

SUMMARY OF THE INVENTION

The primary object of the present invention is to provide an improved box packing machine in which containers fed continuously in multi-files are formed in a group of a given number and all of the containers in this group are simultaneously loaded in a box such as a carton thereby the containers are spaced apart one another at a predetermined distance to avoid interference with the separator already placed in the box.

Another object of the present invention is to present a box packing machine in which a container space regulating unit is provided in such a way that it can travel between the first and second positions defined in a machine housing, and, when located at the first position, the container space regulating unit receives a predetermined number of containers in multi-files with the distance between the adjacent files set at a predetermined value and then, while the container space regulating unit advances to the second position, the spacing between the adjacent containers in each file is set to a predetermined value.

A further object of the present invention is to provide an improved box packing machine which is capable of arranging containers of a given number to a desired format in which the space between adjacent containers is set to a predetermined value by using relatively simple mechanical means.

A still further object of the present invention is to provide an improved box packing machine which is structured to avoid the occurrence of falling down or positional shifting of a container during the process of arranging the containers to a desired format.

A still further object of the present invention is to provide an improved box packing machine which can guarantee that containers of a given number are always loaded in a box by electrically detecting that containers of a given number are supplied to the container space regulating unit.

Other objects, features, and advantages of the present invention will become apparent after a reading of the remainder of this specification and the attached drawings.

BRIEF DESCRIPTION OF THE DRAWINGS

FIG. 3 is a sectional view taken along III—III line shown in FIG. 2 to show the interior of the machine, FIG. 4 is a side view of the machine shown in FIG. 1.

DESCRIPTION OF THE PREFERRED EMBODIMENTS

Referring to FIGS. 1 to 4, containers such as bottles are supplied in six files by belt conveyors 1 to a container space regulating unit 2 disposed inside a box packing machine in accordance with the present invention. When the containers of a given number in six files are placed on the unit 2, the distance between any two adjacent files is set to a desired value, but the neighboring containers in each file are virtually in contact. The spacing between adjacent containers in each file is set to a predetermined value by the function of the unit 2.

When the unit 2 is located at the first position, as shown in FIG. 3, containers are continuously supplied in six files to the unit 2 up to thirty of them, that is five containers in each file. These thirty containers form a group to be transferred into a box in unison. Upon receipt of thirty containers by the unit 2, the next following containers are temporarily held stationary. Then the unit 2 advances to the second position which is defined immediately below a holder head 3 and where the containers are transferred into a box. During this advancement, the containers riding on the unit 2 are spaced apart one another at a predetermined value in each file, i.e., in the direction of the advancement of the unit 2. Thus, when the unit 2 arrives at the second position, the containers on the unit 2 are arranged in a desired format in which any distance between two adjacent containers is set at a predetermined value.

Figure 2:
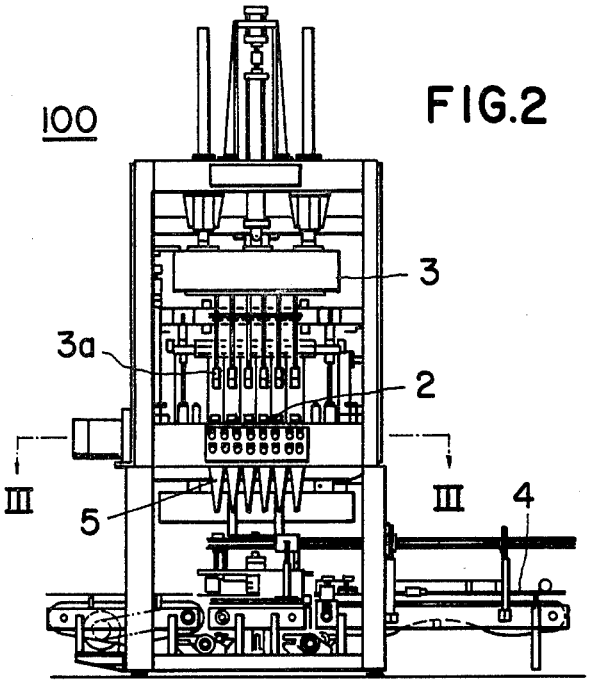
FIG. 2 is a front view of the machine shown in FIG. 1.

Then the holder head 3 starts its downward motion. As best shown in FIGS. 2 and 4, the holder head 3 is provided with holders 3*a* corresponding in number to the containers on the unit 2 whereby each holder can hold one container. When the holders 3*a* hold the containers on the unit 2, the holder head 3 starts its upward motion while the unit 2 starts its returning motion to the first position. During its returning motion, a container space regulating mechanism structured in the unit 2 is reset to the original state. Upon arriving at the first position, the containers temporarily held stationary are released and the unit 2 receives a next group of containers.

Figure 1:
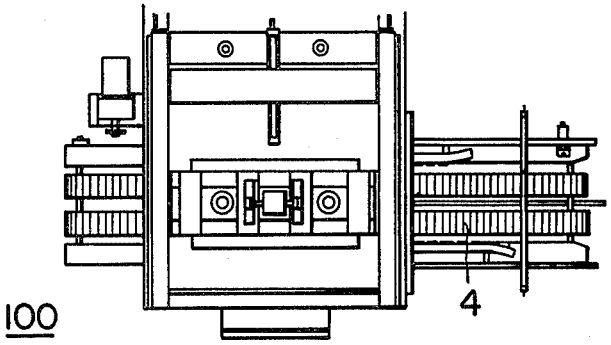
FIG. 1 is a plan view showing a box packing machine which is one embodiment of the present invention.

When the unit 2 returns to the first position, the holder head 3 resumes its downward motion and the containers held by the holders 3*a* are carried even below the horizontal transporting surface of the conveyors 1. As shown in FIGS. 1, 2, and 4, conveyors 4 are disposed below the holder head 3 and in such a way that its transporting direction is perpendicular to that of the conveyors 1. The conveyors 4 carry a box in which the containers held by the holders 3*a* are to be placed. When the box carried on the conveyors 4 comes to the position directly below the holder head 3, it stays there for a short period of time. During this period, the holder head 3 moves down to transfer the containers held by the holders 3*a* into the predetermined positions defined by a separator in the box through guide members 5. Since the containers are arranged in a desired format corresponding to the spatial arrangement defined by a separator in the box, the container loading operation can be carried out smoothly and securely without any interference between the containers and the separator. When the containers are placed inside the box, the holders 3*a* release them, and then the holder head 3 starts its upward motion to return to its original position. On the other hand, the box properly loaded with the containers resumes its motion and is discharged out of the machine by the conveyors 4. In this manner, the box packing operation takes place repetitively.

The detailed structure of the container space regulating unit 2 is shown in FIGS. 5 to 9. Broadly speaking, the unit 2 comprises five elongated container support tables 6, arranged side by side in the reciprocating direction of the unit 2, and a carriage 7 on which the container support tables 6 are provided.

Figure 5:
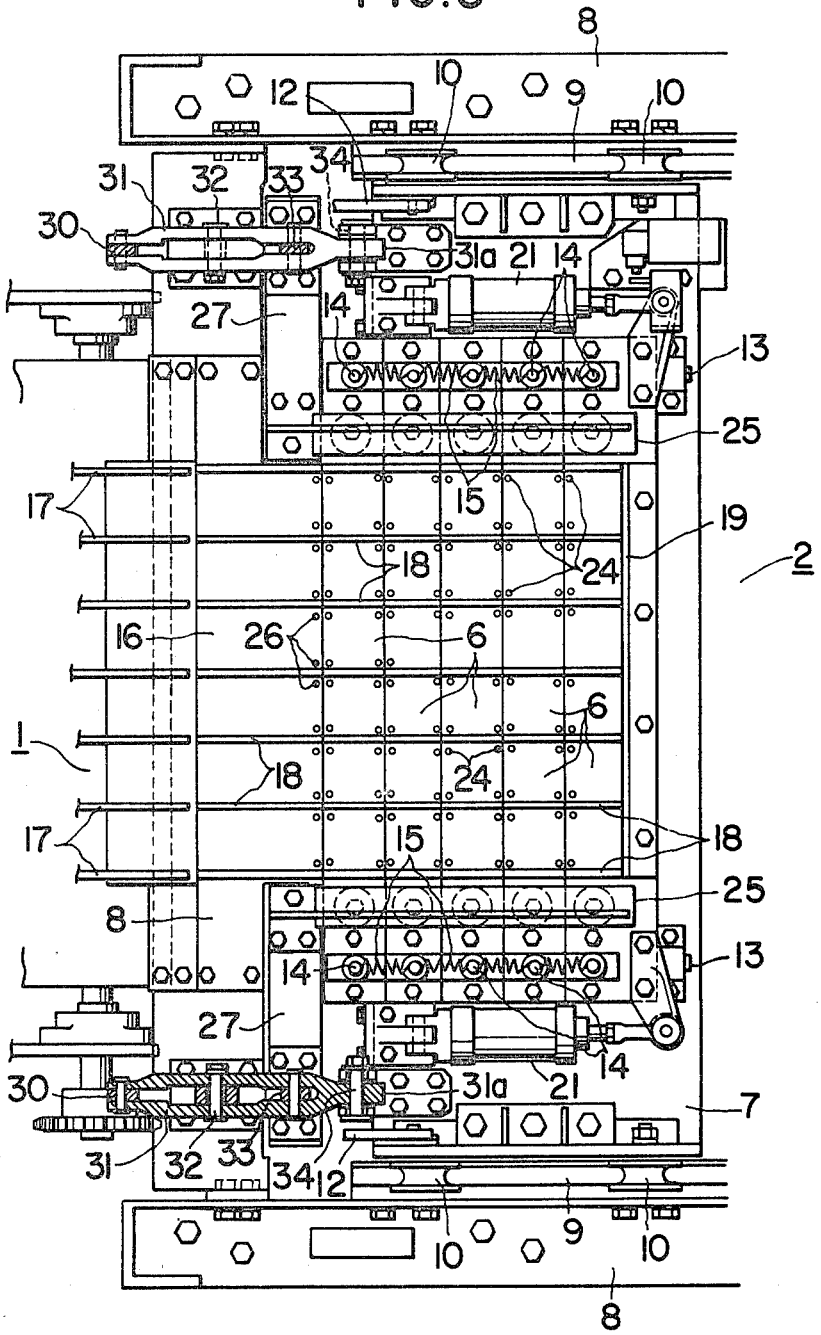
FIG. 5 is an enlarged plan view showing one embodiment of a container space regulating unit which is provided in a reciprocatingly movable manner in the box packing machine.
Figure 6:
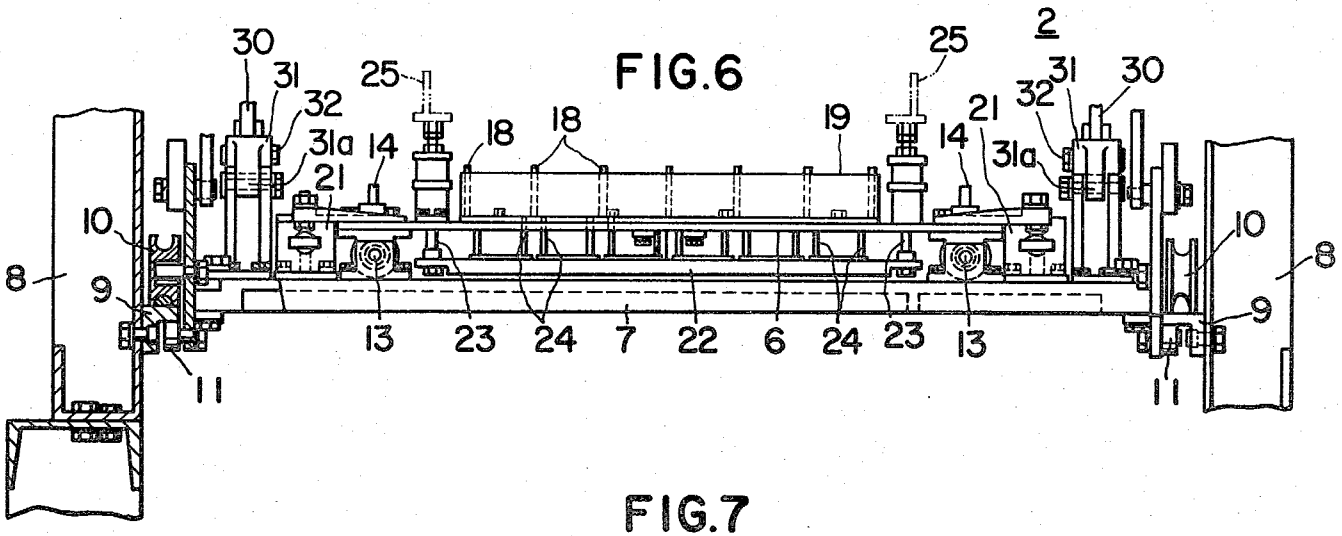
FIG. 6 is a front view of the unit shown in FIG. 5.

As shown in FIGS. 5 and 6, the carriage 7 is movably supported on a pair of guide rails 9 horizontally fixed on both sides of the machine housing 8 through top wheels 10 and bottom wheels 11. The carriage 7 is driven by a driving source (not shown) through a rod 12, and it reciprocates between the first and second positions. The support tables 6 except the left most one, hereinafter referred to rear support table, in FIG. 5 are movably supported at both ends on a pair of guide rails 13 extending in the reciprocating direction of the carriage 7. The rear support table is fixedly provided on the carriage 7. Pins 14 are planted at both ends of each support table 6, and a spring 15 is extended between the adjacent pins 14. The support tables 6 are normally held in contact each other owing to the force of these springs 15. When the unit 2 is in the first position, one side edge of the rear support table 6 abuts against the leading edge of a bridge plate 16 so that containers of a given number from the conveyors 1 move along the bridge plate 16 to be transferred onto the support tables 6. Guide plates 18 are provided above the bridge plate 16 and the support tables 6 in line with the conveyor guide plates 17. The front support table 6, which is the right most one in FIG. 5, is provided with a stopper plate 19 at its front end to prevent the containers from falling off.

Figure 7:
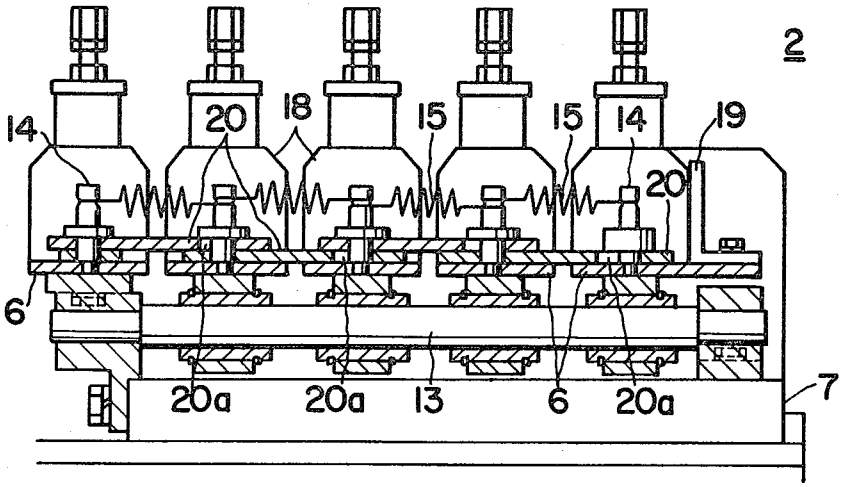
FIG. 7 is a partially sectional view showing one embodiment of the main part of the container space regulating unit.

As shown in FIG. 7, connection plates 20 are provided to extend between any two adjacent pins 14 planted in the support tables 6. One end of each of the connection plates 20 is fixed to one pin 14, whilst the other end is provided with a slot 20*a* in which another pin 14 is loosely fitted. Each slot 20*a* is so structured that it is long enough to separate the support tables 6 each other to arrange the containers in a desired format. As shown in FIGS. 5 and 6, each end of the front support table 6 is connected to a cylinder actuator 21 provided on the carriage 7 so that the support tables 6 can move along the guide rails 13. Thus, if the front support table 6 is moved forward against the force of the springs 15 by this cylinder actuator 21, the support tables 6 change their arrangement from the state in which adjacent tables 6 are in contact due to the force of the springs 15 to the state in which the support tables 6 are spaced apart each other at a predetermined distance defined by the length of the slots 20*a*.

As shown in FIG. 6, below each support table 6 is disposed an elongated plate 22 each end of which is connected to a vertical rod 23. The rod 23 slidably passes through the support table and is normally biased upward by a spring (not shown). A plurality of stopper pins 24 are planted on the top surface of the plate 22 and they are so arranged that they can move through holes of the support table 6 to project above the surface thereof to hold the bottom portion of each of the containers at four points. These stopper pins 24 are normally projecting above the surface of the support table 6 because the rods 23 are biased by means of a spring in the upward direction. However, at the time of supplying containers to the support tables 6 from the conveyors 1, the stopper pins 24 are moved downward by a press down member 25 which presses the rods 23 in the downward direction so that the stopper pins 24 become located below the surface of the support tables to avoid interference with the containers being fed.

Figure 9:
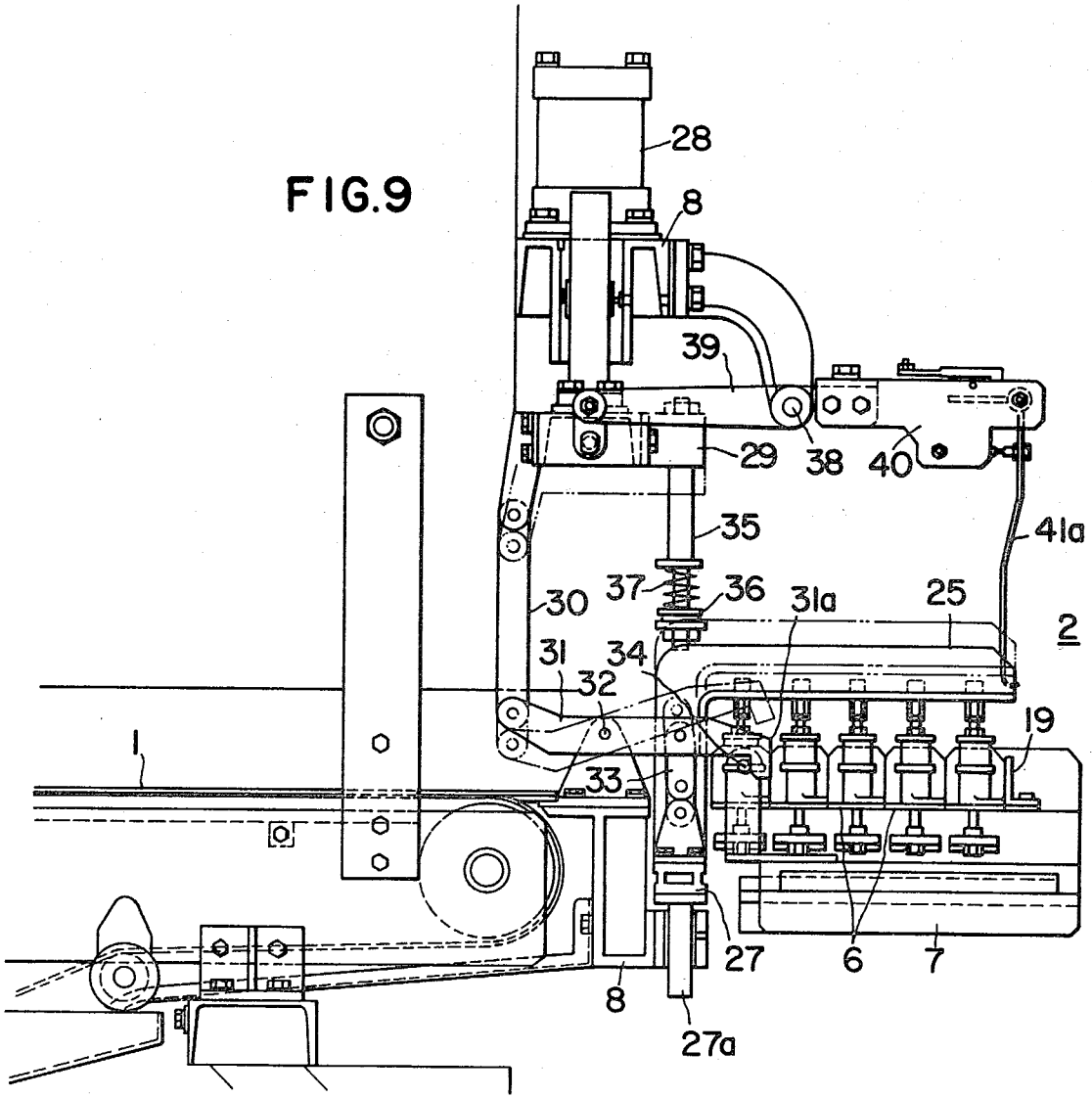
FIG. 9 is a schematic illustration showing another part of the structure shown in FIG. 8, FIGS. 10 and 11 are partially sectional views showing different embodiments of the main part of the container space regulating unit.

Limit pins 26 are provided in the vicinity of the leading edge of the bridge plate 16. These limit pins 26 can be projected above the surface of the bridge plate 16 to limit the number of containers to be fed to the unit 2. These limit pins 26 are planted in a limit pin plate 27 which is disposed below the bridge plate 16. The limit pin plate 27 has a guide rod 27*a* at each end, which, in turn, is slidably supported by the machine housing in the vertical direction. As shown in FIG. 9, the press down member 25 is connected to the limit pin plate 27. Therefore, when the limit pin plate 27 moves downward, the limit pins 26 and the stopper pins 24 are simultaneously retracted below the top surface of the bridge plate 16 and of the support tables 6 to permit the supply of containers to the unit 2. While, when the limit pin plate 27 moves upward, both of the pins 24 and 26 come to project above the top surface thereby the limit pins 26 limit the supply of containers and the stopper pins 24 securely hold the containers at their respective positions.

FIG. 9 shows a mechanism for controlling the vertical movement of the limit pin plate 27, a cylinder actuator 28 as a driving source for the limit pin plate 27 is fixedly provided at a top portion of the machine housing 8. To each end of an elongated bracket 29, which is attached to the cylinder actuator 28, is connected one end of a link 30, the other end of which is connected to one end of an arm 31. The arm 31 is pivoted to a pin 32 of the machine housing 8 and the arm 31 is operatively connected to the limit pin plate 27 through a link 33. A hook 31*a* is formed at the other end of the arm 31 as a projection which extends downward. When the carriage 7 is located at the first position to receive containers of a given number, the hook 31*a* is in engagement with a pin 34 planted on the carriage 7 to securely hold the carriage 7 at the first position.

The bracket 29 is also provided with a rod 35 at each end, which extends vertically downward, and a holding plate 36 is attached to the rods 35. The holding plate 36 is located immediately above the containers which are restrained their movement by the limit pins 26 so that it can hold the restrained containers from above with imparting a slight downward force due to a spring 37.

Figure 8:
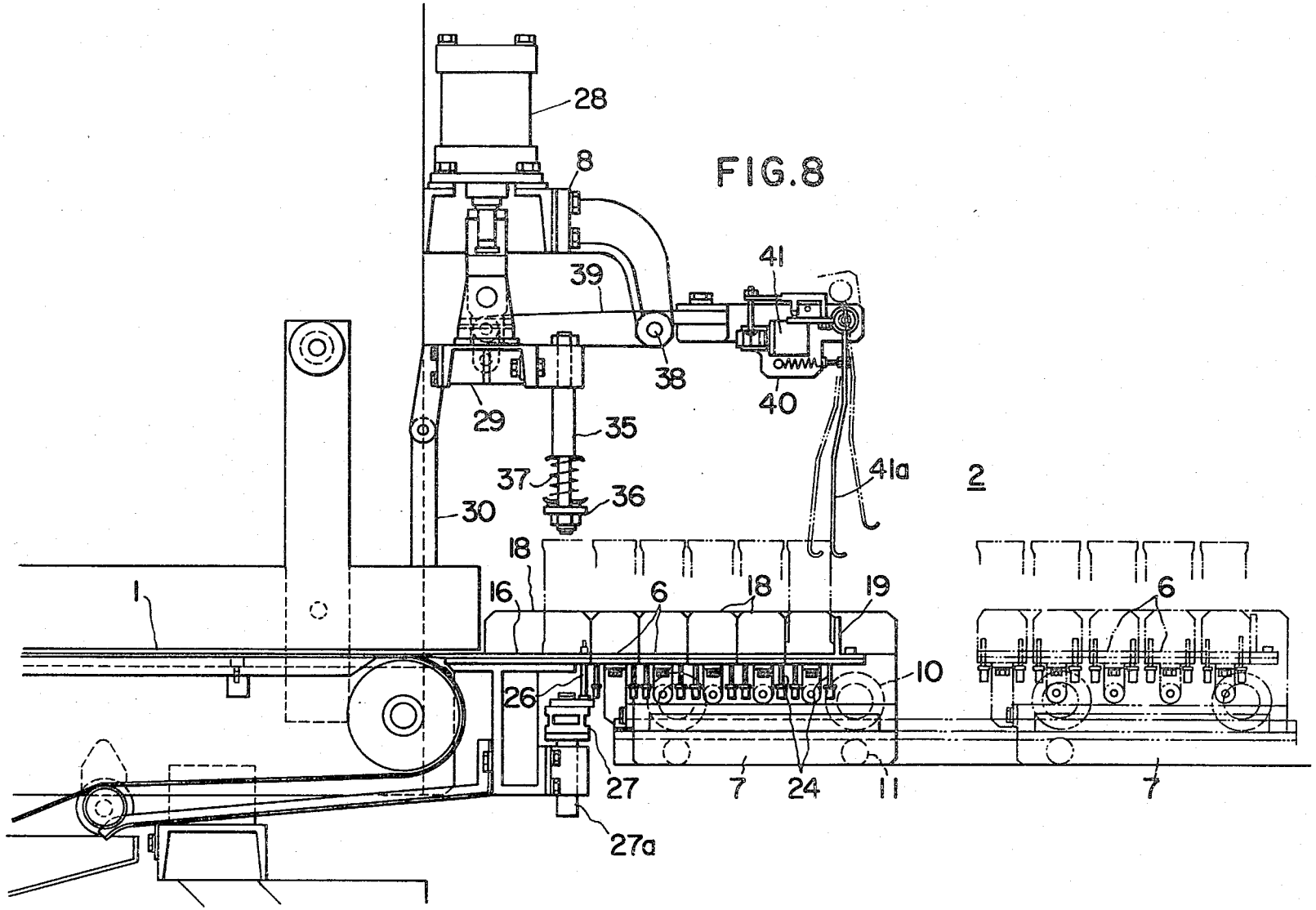
FIG. 8 is a schematic illustration showing the structure of supplying a predetermined number of containers to the container space regulating unit.

The bracket 29 is connected to one end of an arm 39 which is pivotted at a pin 38. As shown in FIG. 8, an elongated support member 40 mounted at the other end of the arm 39 is provided with limit switches 41 to sense the existence of the containers of a given number on the support tables 6. One limit switch 41 is disposed for each file of the containers and a feeler 41*a* is operatively connected to each of the limit switches 41. When the containers of a given number are supplied to turn all the limit switches 41 on, the cylinder actuator 28 is operated to move the bracket 29 in the downward direction.

When the carriage 7 returns from the second position to the first position, the cylinder actuator 28 is energized to move the bracket 29 upward to pivot the arm 31 clockwise in FIG. 9 to bring the hook 31*a* in engagement with the pin 34 of the carriage 7. Along with the clockwise pivotting of the arm 31, the limit pin plate 27 moves downward since it is operatively connected to the arm 31 through the link 33 so that the press down member 25 mounted on the limit pin plate 27 and the limit pins 26 move downward. The downward motion of the press down member 25 causes the rod 23 and the plate 22 to move downward thereby the stopper pins 24 are retracted below the top surface of the support tables 6. In this situation, since the limit and stopper pins are out of way, the supply of containers from the conveyors 1 resumes. When the bracket 29 is lifted upward, the holding member 36 which has been holding the top portions of the containers restrained by the limit pins 26 moves upward to free the containers; whereas, the limit switches 41 and the feelers 41*a* together with the support member 40 move downward because of the clockwise pivotal motion of the arm 39. While, the support tables 6 of the carriage 7 are brought into a contact state when the carriage 7 returns to the first position.

Upon release of the constraint imparted by the limit pins 26 and the holding plate 36, the containers start to advance in six files into the unit 2 as being driven by the conveyors 1 and guided by the guide plates 18. The front container in each file finally comes into contact with the stopper plate 19 and its further advancement is restricted. At the same time, the front container turns the limit switch 41 on by engaging with the feeler 41*a*. When all of the six limit switches 41 are turned on, the cylinder actuator 28 is energized to move the bracket 29 downward.

The downward movement of the bracket 29 causes to project the limit pins 26 above the top surface of the bridge plate 16 thereby limiting the further supply of containers, and to bring the holding plate down to securely hold the containers restrained by the limit pins 26 from above. Simultaneously therewith, the stopper pins 24 are projected above the top surface of the support tables 6 to securely keep the containers at their respective positions, and the feelers 41*a* of the limit switches are moved out of the way of the containers. Besides, the hook 31*a* of the arm 31 becomes disengaged with the pin 34 to make the carriage 7 ready to move.

Then the carriage 7 advances to the second position as being driven by a driving mechanism (not shown). In association therewith, the cylinder actuator 21 provided on the carriage 7 becomes energized to move the front support table 6 with respect to the carriage 7. This causes to move all of the support tables 6 except one located at rear with respect to the carriage 7, i.e., the rear support table, until the further movements become restrained by the slots 20*a* of the connection plates 20. In this fashion, the containers are separated each other in each file. Since each of the containers on the support tables is kept at a proper position with the four pins, the likelihood of dancing around and/or falling down of the container is advantageously eliminated.

Upon arrival of the unit 2, on which the containers of a given number are arranged in a desired format with a predetermined distance between adjacent ones, at the second position, the holder head 3 provided with holders 3*a*, extending downward and corresponding in number and position of the containers on the unit 2, comes down to hold the containers. Then the containers are lifted upward to the position where they do not interfere with the carriage 7 or the support tables 6. Thereafter, the unit 2 returns to the first position during which the support tables of the carriage 7 are brought back to the original contact state. On the other hand, when the unit 2 moves far enough toward the first position, the holder head 3 starts its downward movement to place the containers into the box. Leaving the containers in the box, the holder head 3 moves upward to return to the original upper position. These steps as described above are repeated to automatically pack a box with containers of a given number extremely smoothly and without interference between the separator in a box and the containers.

Figure 10:
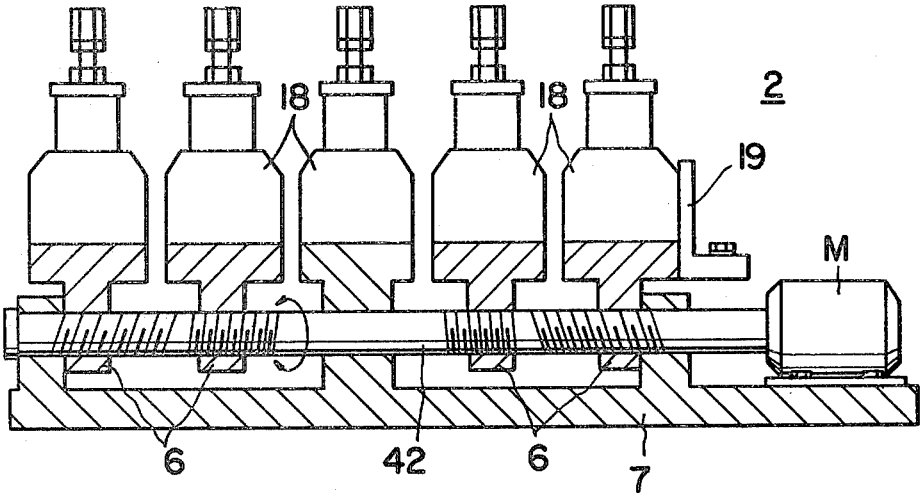
Figure 11:
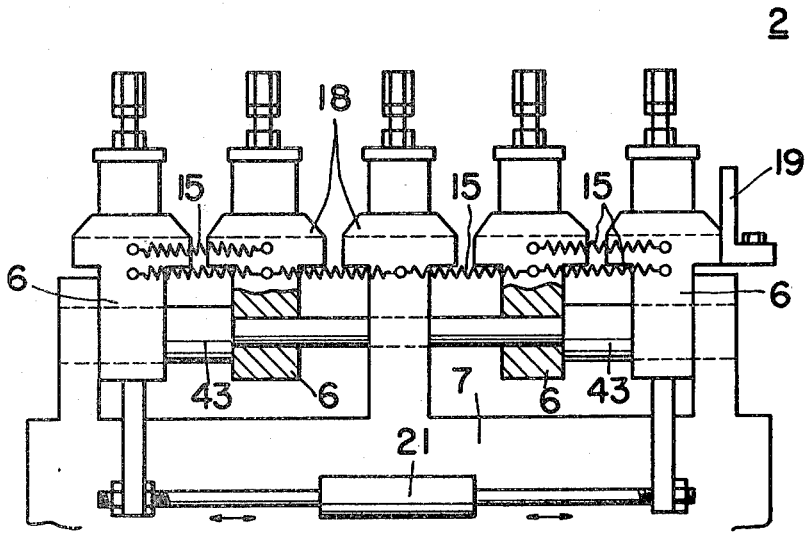

In the embodiment described above, the rear support table 6 is fixedly provided on the carriage 7. Another alternative is to fix the front or central support table to the carriage. Moreover, in the above described embodiment, the mechanism for regulating the distance between the adjacent support tables comprises pins 14, springs 15, connection plates 20, slots 20*a*, cylinder actuators, etc. While, another alternative is to employ a threaded rod 42 which has a pair of forward threaded portions different in pitch and another pair of backward threaded portions different in pitch as shown in FIG. 10. A further alternative is to employ a rod, or bar, with stepped portions 43 as shown in FIG. 11.

It will be understood that various changes in details, materials and arrangements of parts, which have been herein described and illustrated in order to explain the nature of the invention, may be made by those skilled in the art within the principle and scope of the invention as expressed in the appended claims. However, while the invention has been described with reference to the structure disclosed herein, it is not to be confined to the details set forth, and this application is intended to cover such modifications or changes as may come within the scope of the following claims.

I claim:

1. A box packing machine for placing containers of a given number into a box comprising a machine housing, a container space regulating unit which is movable reciprocatingly between the first and second positions defined in said machine housing, container supply means for supplying containers of a given number to said container space regulating unit while being located at the first position, arranging means provided on said container space regulating unit for arranging the containers to a desired format while said container space regulating unit advances from the first position to the second position, and a holder head, disposed vertically movably at the second position, which includes a plurality of holders for individually holding the upper portions of said containers in a desired format.

2. A box packing machine according to claim 1, wherein said container space regulating unit comprises a carriage movably carried on a pair of guide rails extending between the first and second positions and said arranging means comprise a plurality of container support tables disposed side by side on said carriage in the direction of motion of said carriage.

3. A box packing machine according to claim 2, wherein each of said container support tables is composed of an elongated plate for supporting a plurality of containers thereon, and wherein said machine includes a plurality of guide plates for setting the spacing between adjacent containers on each of said container support table to a predetermined value.

4. A box packing machine according to claim 2, wherein said container space regulating unit includes stopper means for keeping the containers at their respective positions on said container support tables while said unit moves from the first to the second position.

5. A box packing machine according to claim 4, wherein said stopper means includes a plurality of stopper pins provided to be movable between a projected position and a retracted position with respect to the top surface of said container support tables.

6. A box packing machine according to claim 2, wherein the front support table is provided with a stopper plate at its front end for preventing the containers from falling off.

7. A box packing machine according to claim 2, wherein said arranging means includes a plurality of pins each of which is planted in each of said container support tables, a plurality of springs each of which extends between said adjacent pins to normally keep said container support tables in contact, and a plurality of connection plates each of which has one end fixed to one of said pins and the other end provided with a slot in which the neighboring pin is loosely fitted.

8. A box packing machine according to claim 6, wherein said container support means includes sensing means for sensing the presence of a container in contact with said stopper plate and restraining means energized in response to the signal from said sensing means for restraining the advancement of the containers immediately beyond a predetermined number.

9. A box packing machine according to claim 8, wherein said carriage includes a bridge plate, fixed thereon in flush with said container support tables, for bridging between outside conveyors and said container support tables when said container space regulating unit is located at the first position.

10. A box packing machine according to claim 9, wherein said restraining means includes a holding plate which is moved downward in response to the signal from said sensing means and a plurality of pins provided to be movable in response to the signal from said sensing means between a projected position and a retracted position with respect to the top surface of said bridge plate.

11. In a box packing machine for placing containers of a given number into a box comprising a machine housing, a pair of guide rails extending between the first and second positions defined in said machine housing, a carriage movably carried on said guide rails, driving means for reciprocating said carriage between the first and second positions, a plurality of container support tables disposed side by side on said carriage in the reciprocating direction of said carriage, and space regulating means for regulating the spacing in said container support tables; the improvement residing in that said space regulating means comprises threaded projections each of which is provided on each of said container support tables, a shaft having threaded portions individually engageable with said threaded projections, and driving means for reversibly rotating said shaft.

12. In a box packing machine for placing containers of a given number into a box comprising a machine housing, a pair of guide rails extending between the first and second positions defined in said machine housing, a carriage movably carried on said guide rails, driving means for reciprocating said carriage between the first and second positions, a plurality of container support tables disposed side by side on said carriage in the reciprocating direction of said carriage, and space regulating means for regulating the spacing of said container support tables; the improvement residing in that said space regulating means comprises bored projections each of which is provided on each of said container support tables, spring means for always biassing said container support tables into contact, a stepped shaft which passes through said bored projections, and driving means for moving said container support tables away from each other.

* * * * *